United States Patent [19]

Stilling

[11] 4,169,327

[45] Oct. 2, 1979

[54] SIGN BOX STRUCTURE

[76] Inventor: Johann Stilling, A1001,1141 Royal York Rd., Islington, Canada

[21] Appl. No.: 859,091

[22] Filed: Dec. 9, 1977

[51] Int. Cl.[2] ..... G09F 13/04

[52] U.S. Cl. ..... 40/549; 40/152.2; 40/574; 40/578; 52/656

[58] Field of Search ..... 40/574, 572, 607, 605, 40/578, 564, 152.1, 152.2, 152, 155, 549, 156; 52/656, 476; 403/401, 402, 403; 220/84 R, 80

[56] References Cited

U.S. PATENT DOCUMENTS

| | | | |
|---|---|---|---|
| 2,620,580 | 12/1952 | Dwinell | 40/549 X |
| 3,013,475 | 12/1961 | Spangler | 40/574 |
| 3,131,793 | 5/1964 | Bohn | 52/656 |
| 3,345,790 | 10/1967 | Cornelissen | 52/476 |
| 3,863,372 | 2/1975 | Stilling | 40/549 X |

FOREIGN PATENT DOCUMENTS

| | | | |
|---|---|---|---|
| 975921 | 10/1975 | Canada | 52/656 |

OTHER PUBLICATIONS

Modern Plastics, vol. 28, issue 7, p. 62, 3-1951.

*Primary Examiner*—John F. Pitrelli

[57] ABSTRACT

A sign structure comprises a housing with linear extrusion side members interconnected and separated by curved corner members which are telescopically received in the ends of those side members. A front panel or frame for such a sign is similarly formed from linear extrusion frame members interconnected and separated by curved frame corner members, the various frame members being co-extensive in elevation with the corresponding housing members. Forwardly facing channels are formed along the front edges of the housing side members for receiving rearwardly projecting J-shaped flanges provided on the linear frame members, such flanges being retained in position by screws. Any of the J-shaped flanges can rotate in its housing channel to permit the front panel to be hinged open when the screws along all the other edges are loosened to allow the other J-shaped flanges to leave their housing channels. A continuous rubber weather seal is provided on flanges formed on all the housing side members and housing corner members for engagement by suitable members provided on all the frame members and frame corner members.

9 Claims, 14 Drawing Figures

-156-

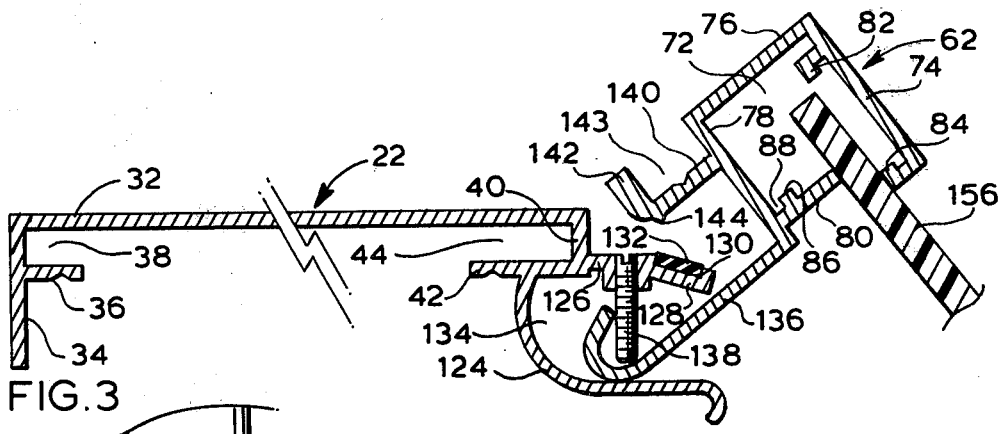
FIG. 3
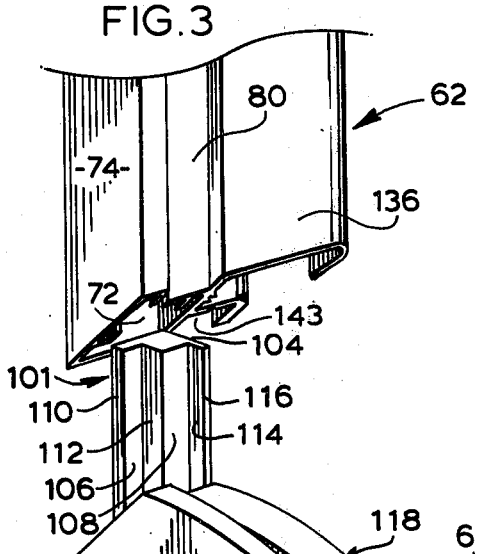
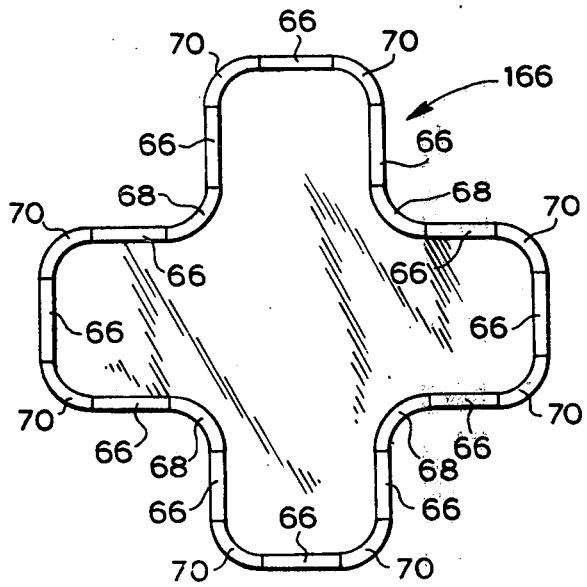
FIG. 11c
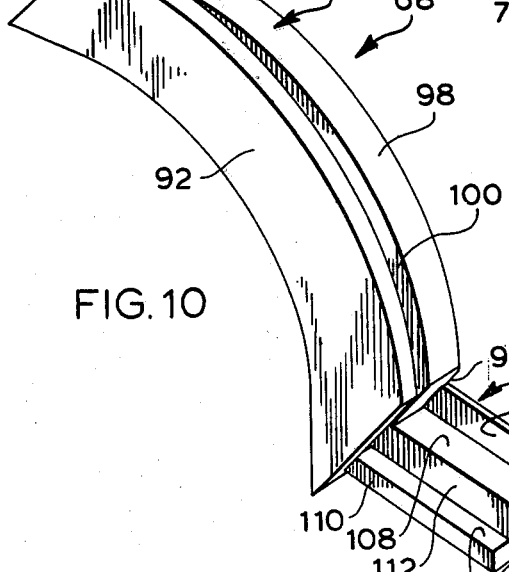
FIG. 10
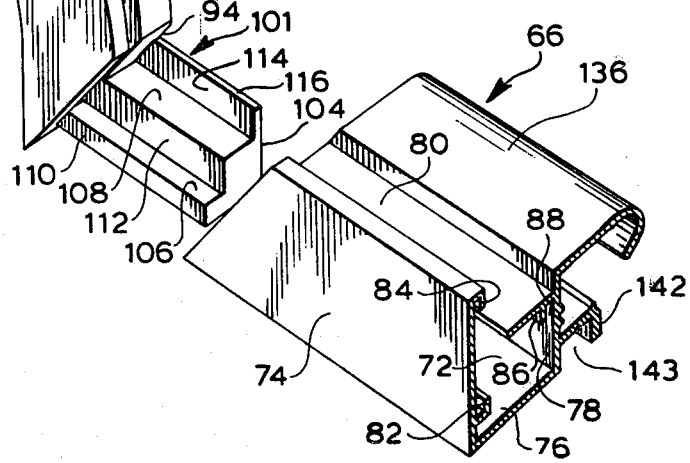

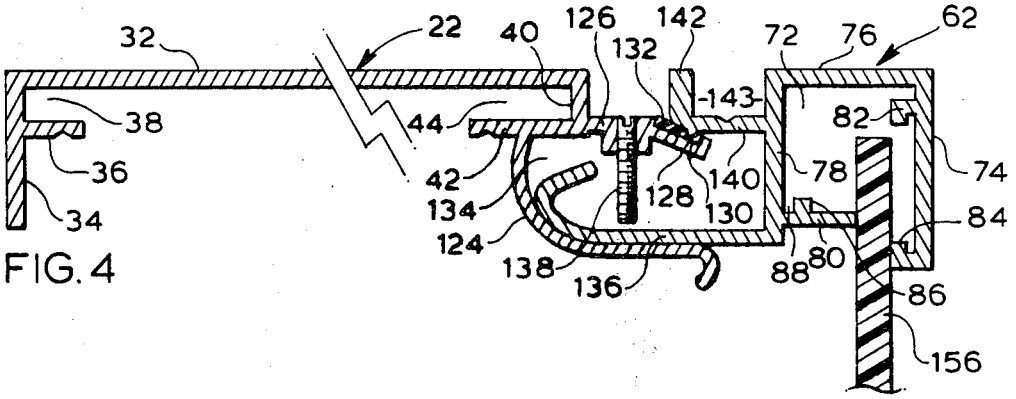
FIG. 4
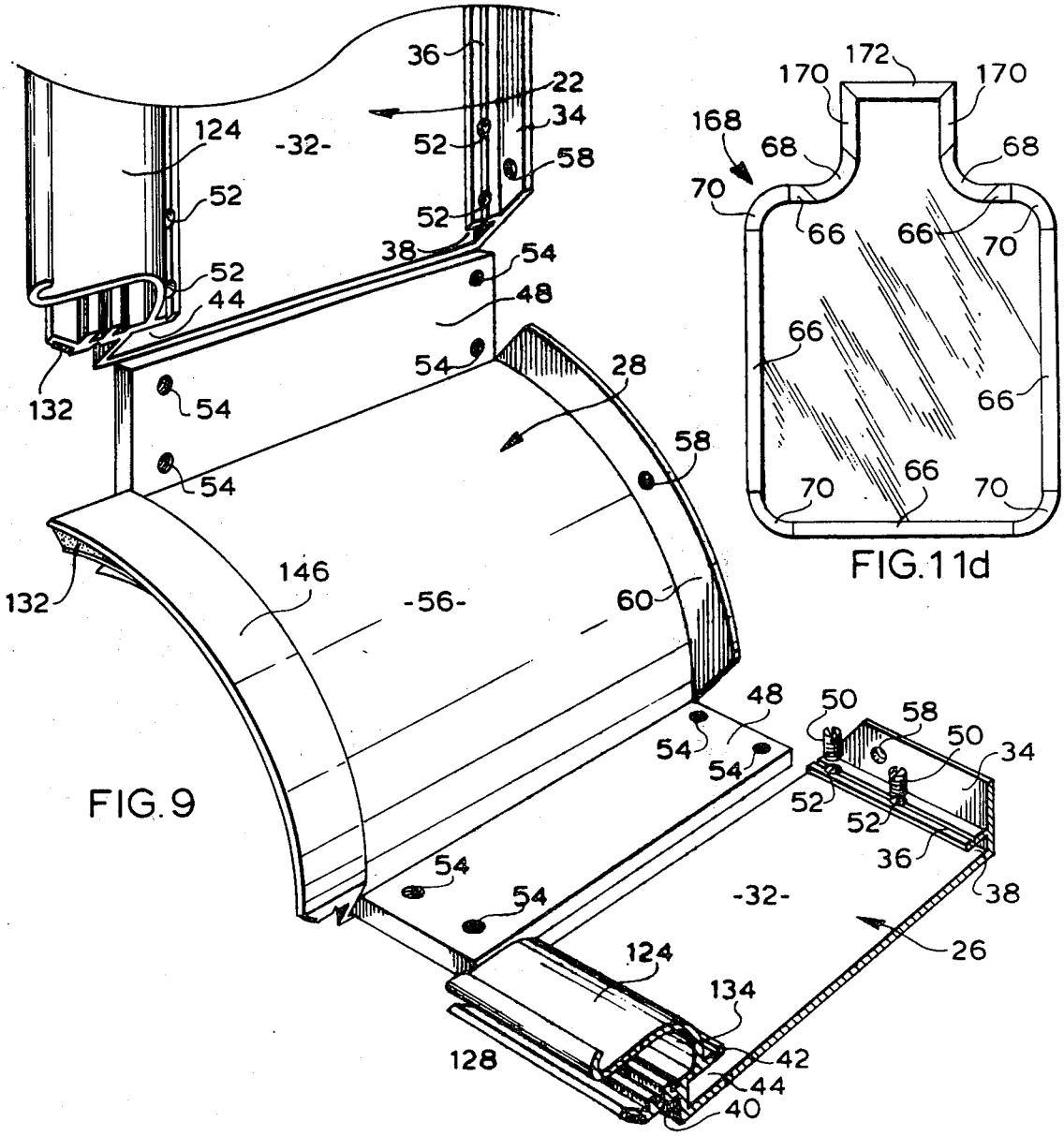
FIG. 9
FIG. 11d

SIGN BOX STRUCTURE

The present invention relates to sign structures and more particularly to structures intended to be used in illuminated signs of the type in which at least one panel carrying a translucent sign-carrying pane is mounted on a housing in which incandescent or fluorescent lamps are provided for back-lighting such a pane to show advertising or other information provided on such pane as opaque areas or areas of contrasting colours.

Such a sign is often supported over the entrance to a store or other building. When such a sign is provided with only a single panel, the sign may be secured with its back surface against a building wall. Such a sign may also be provided with two pane-carrying panels, one secured to the front surface of the housing and the other secured across the rear surface of the housing. Such a double-sided sign may be supported so as to project angularly with respect to a building wall and/or by the use of a supporting arm extending below the sign housing or by suitable suspension means connected to the top of the sign housing.

Such signs are generally exposed to the elements and it is necessary, therefore, to provide such sign structures with suitable weather sealing between the sign housing and the panel or panels of such a sign.

Additionally such signs are normally assembled in factories and then taken to the sites where they are to be installed. With a one-sided sign, it is generally necessary to remove the front panel of the sign to allow the sign housing to be secured to the building wall or other structure. After the sign housing has been so mounted, the front panel must then be replaced on the housing and secured properly in position to prevent it from coming off the housing, for example, in the case of high winds, and possibly injuring a person walking below the sign. In the case of double-sided signs, it is often necessary to remove either the front or rear panel to attach the sign supporting members or for the electrical installation of the sign.

Additionally, it is frequently necessary to obtain access to the housing interior of such a sign for maintenance purposes, for example, to replace electrical lamps provided therein.

Various proposals have heretobefore been made for supporting and securing the panels of such signs on their housings and in Canadian Pat. No. 909,506 entitled "Sign With Hinged Front Panel" issued Sept. 12, 1972 to Johann Stilling, there is described one such sign structure. The sign structure described and claimed in that Canadian patent is intended for use with illumination elements and comprises a main frame having a top member, side members and a bottom member for the illumination elements and at least one open side defined by the side edges of said members; support means on at least one side edge of said top member of said frame, a front panel for holding a translucent sign element; a curved hinge member extending from said front panel; a concave supporting wall on said support means adapted to receive said curved hinge member to permit relative swinging therebetween, between a closed position and a released position; and removable stop means associated with said support means and interengaging with said curved hinge member in such a manner that said curved hinge member is normally prevented from swinging into said released position and disengaging from said concave supporting wall.

While the sign structure described in the Canadian patent specification hereinbefore identified presented many important practical advantages, it did not lend itself readily to the construction of signs having anything other than relatively plain elevational configurations.

It is accordingly a principal object of this invention to provide a sign structure of the type already generally considered herein but which permits the simple construction of a wide variety of signs of many different and aesthetically pleasing elevational configurations.

It is another object of this invention to provide a sign structure to which the teachings of Canadian Pat. No. 909,506 can still be applied so permitting the practical benefits of such teachings to be realized.

Yet another object of this invention is to provide a sign structure which comprises means to ensure positive weather-tight sealing between the housing of such a sign structure and at least one panel releasably mounted on such housing.

Yet another object of this invention is to provide a sign structure in which a first extrusion can be used for all the side members of the sign housing and in which a second extrusion can be used for all the frame members of one or two panels of such a sign so as to effect substantial economies in the manufacturing cost of such a sign.

Other objects of the invention will become apparent as the description herein proceeds.

SUMMARY OF THE INVENTION

This invention is based in part on the finding that improved versatility in sign design can be obtained by interconnecting linear housing side members of a sign by housing corner members which not only interconnect but also separate two adjacent ones of such housing side members.

The front panel or frame of such a sign structure is then similarly formed by interconnecting linear frame members by frame corner members which similarly interconnect and separate adjacent ones of said frame members. It should be understood that the various frame members and frame corner members will be co-extensive with corresponding ones of the housing side members and housing corner members respectively.

By forming the housing corner members and the frame corner members with arcuate elevational configurations and particularly with outwardly concave or convex elevational configurations, very considerable design versatility is obtained as will readily be understood as the description herein proceeds.

A sign structure in accordance with this invention is also characterized by the provision of a weather-tight seal between the housing and the front panel about the entire peripheral line of contact between those two units.

Broadly, a sign structure in accordance with this invention can be defined as comprising a housing which in turn comprises a plurality of elongated linear housing side members interconnected to provide a structurally rigid and continuous housing side wall and at least one housing corner member interconnecting and separating two adjacent ones of said housing side members; housing locking members securing said housing corner member to each of said two adjacent ones of said housing side members; a front panel frame which in turn comprises a plurality of elongated linear frame members co-extensive with corresponding ones of said housing side members and interconnected to provide a structurally rigid and continuous frame and at least one frame corner member interconnecting and separating two adjacent ones of said frame members and co-extensive with said housing corner member; frame locking members securing said frame corner member to each of said two adjacent ones of said frame members; recesses in said frame members and said frame corner member, such recesses being disposed in a common plane for receiving edge portions of a front panel; first supporting means on said housing; second supporting means on said frame and releasably engaging said first supporting means to support said frame across a major face of said housing; a resilienty compressible seal disposed between said housing side members and corresponding ones of said frame members and between said housing corner member and said frame corner member; and releasable securing means releasably maintaing said first supporting means and said second supporting means in engagement with each other with said seal being compressed to restrict the passage of moisture into said housing.

A sign structure in accordance with this invention will frequently be provided with more than one said housing corner member and with a corresponding plurality of co-extensive frame corner members.

The various features of novelty which characterize this invention are pointed out with particularity in the claims annexed to and forming part of this disclosure. For a better understanding of this invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings in which:

FIG. 3 is a fragmentary section through the sign structure shown in FIG. 1 when taken as indicated by the arrows 3—3 of that figure;

FIG. 4 is a fragmentary section similar to that of FIG. 3 but showing the front panel in its fully closed position;

FIG. 9 is an exploded and fragmentary perspective view from within of the upper left-hand corner of the housing of the sign structure shown in FIG. 1, the view having been rotated through ninety degrees to facilitate comparison with FIG. 5;

FIG. 10 is an exploded and fragmentary perspective view of the upper left-hand corner of the front panel of the sign structure shown in FIG. 1, the view having been rotated through ninety degrees to facilitate comparison with FIG. 6, and, FIGS. 11*a* to 11*d* are front elevations of alternative embodiments of sign structures in accordance with this invention.

Figure 1:
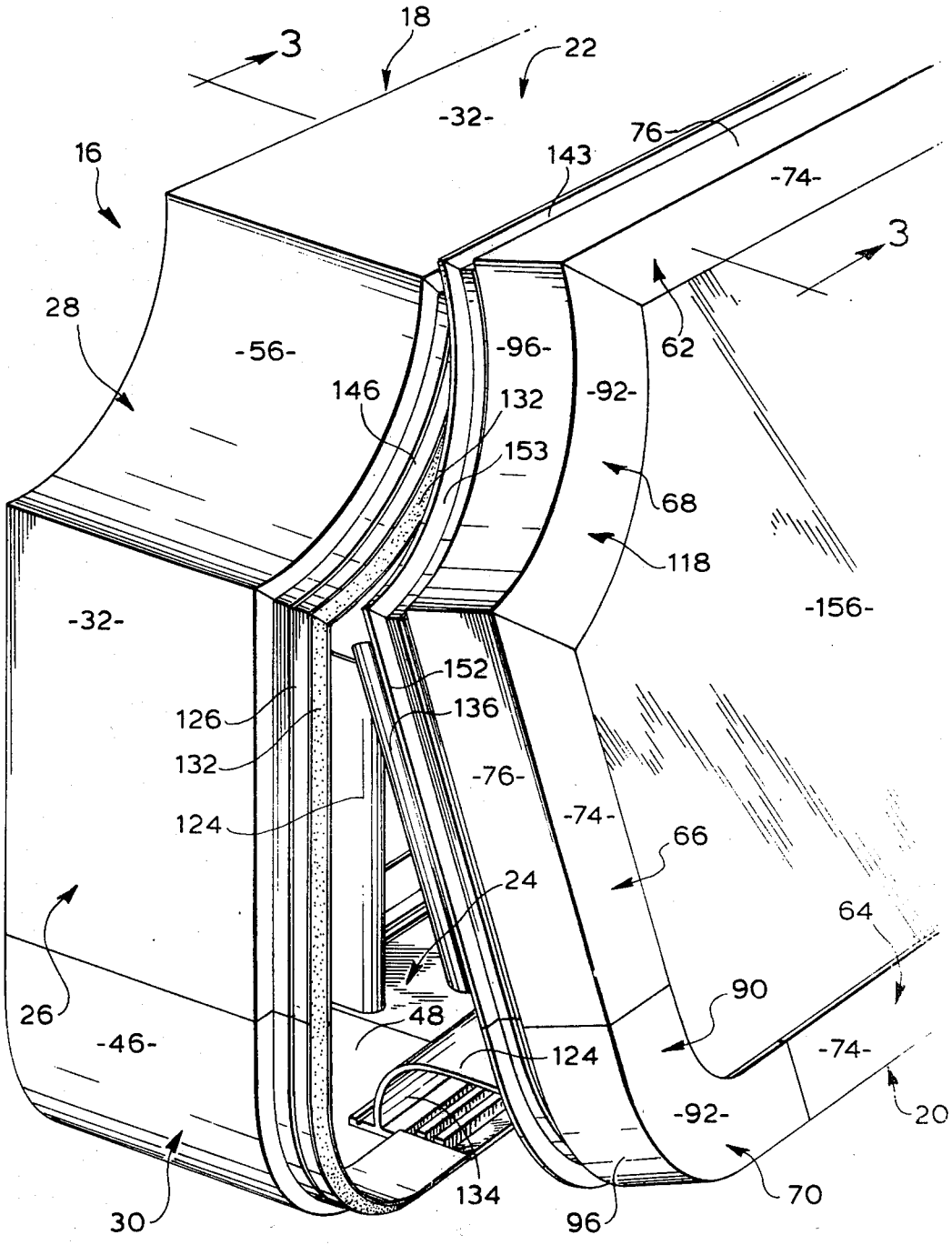
FIG. 1 is a fragmentary perspective view of one embodiment of a sign structure in accordance with this invention and showing a front panel of such a sign structure in a partly opened position thereof.
Figure 11A:
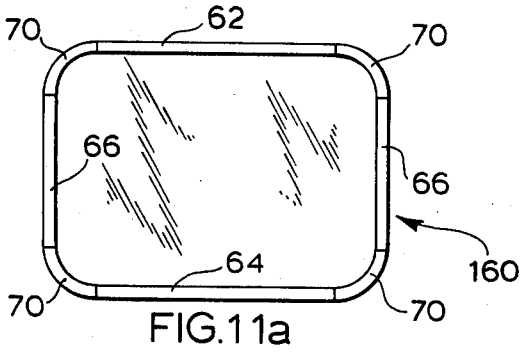
Figure 11B:
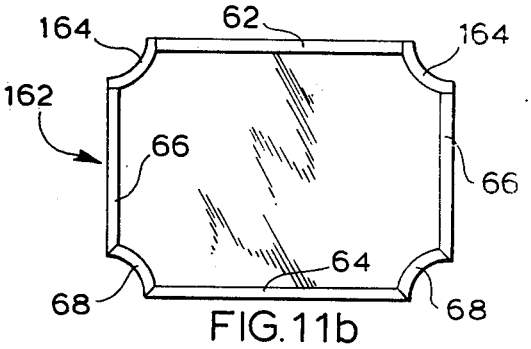
Figure 5:
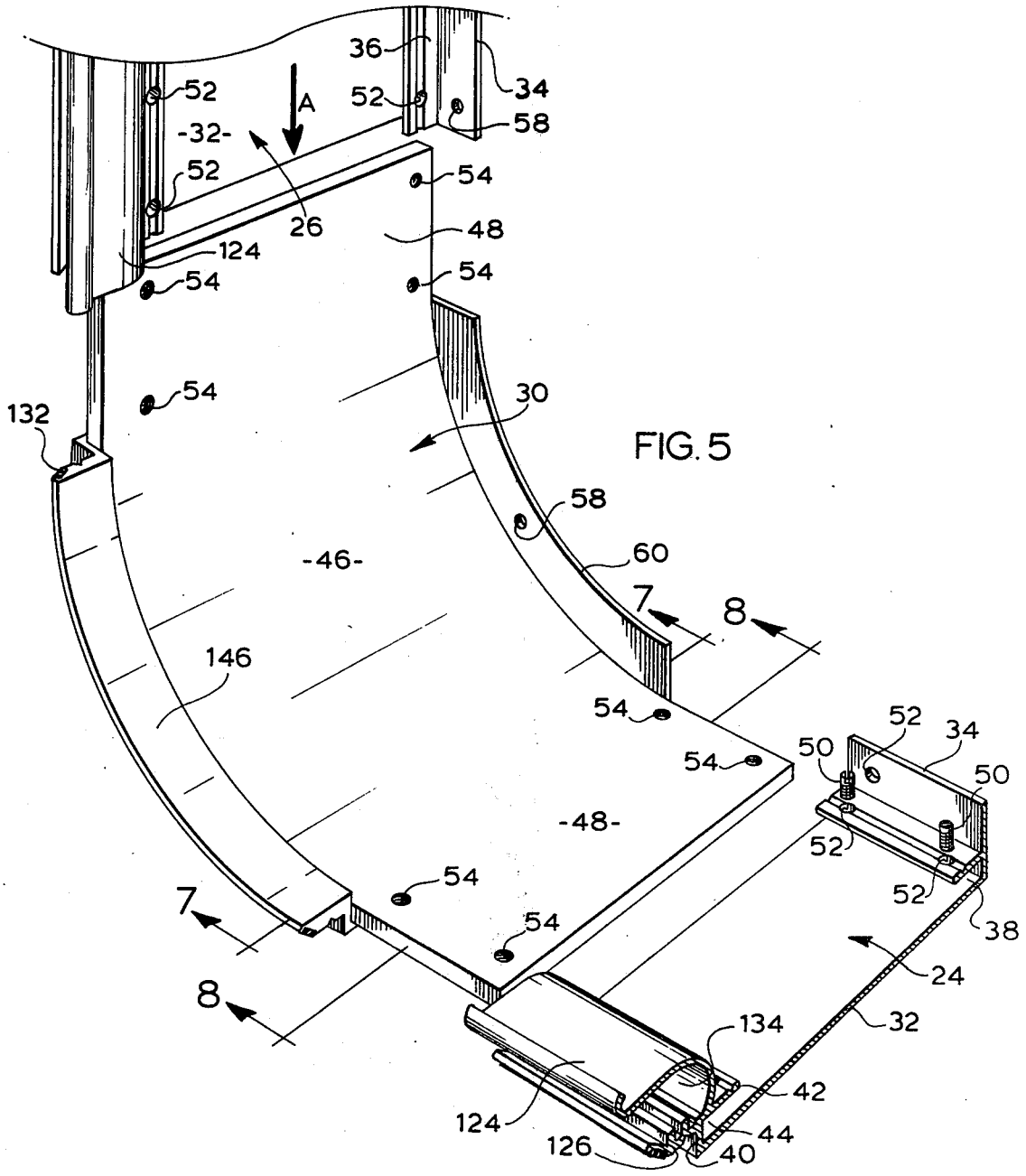
FIG. 5 is an exploded and fragmentary perspective view from within of the lower left-hand corner of the housing of the sign structure shown in FIG. 1.

The several figures of the drawings are located on the appended cards of drawings as follows:

Card #1: FIG. 1;
Card #2: FIGS. 2, 6, 7 and 8;
Card #3: FIGS. 3, 10 and 11*c*;
Card #4: FIGS. 4, 9 and 11*d*;
Card #5: FIGS. 5, 11*a* and 11*b*.

DESCRIPTION OF THE PREFERRED EMBODIMENTS

Figures 2, 6, 7, 8:
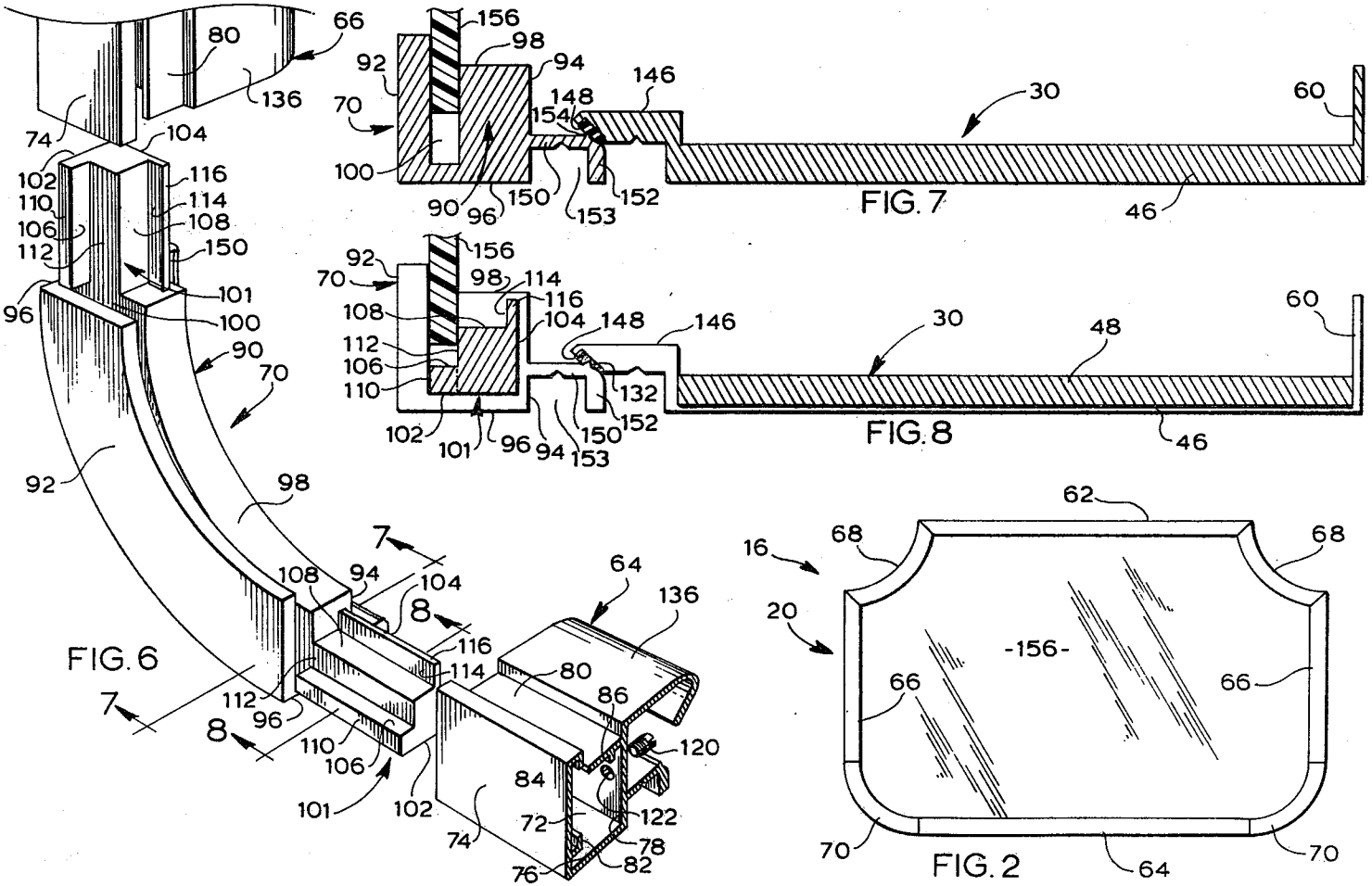
FIG. 2 is a front elevation on a smaller scale of the sign structure shown in FIG. 1.
FIG. 6 is an exploded and fragmentary perspective view of the lower left-hand corner of the front panel of the sign structure shown in FIG. 1.
FIG. 7 is a section through the lower left-hand corner of the sign structure shown in the preceding figures and showing the manner in which corner members of the housing and front panel frame interengage, the section being taken as indicated by the arrows 7—7 of FIGS. 5 and 6.
FIG. 8 is a section similar to that of FIG. 7 but taken as indicated by the arrows 8—8 of FIGS. 5 and 6 with the housing and frame bottom members omitted.

Reference will first be made to FIGS. 1 and 2 of the accompanying drawings in which there is indicated generally by the legend 16 one embodiment of a sign structure in accordance with this invention. The sign structure 16 comprises a housing generally indicated at 18 and a front panel or cover generally indicated at 20 and which is releasably secured on the housing 18 to close the front face of that housing.

The housing 18 comprises a top member generally indicated at 22, a bottom member generally indicated at 24 and two side members generally indicated at 26 but only one of which is visible in FIG. 1. These four members are all formed as identical elongated linear extrusions of suitable lengths and will be generally referred to herein as being side members of the housing 18.

The housing 18 also comprises two identical upper housing corner members generally indicated at 28 and two identical lower housing corner members generally indicated at 30.

The housing side members 22, 24 and 26 are interconnected and separated by appropriate ones of the housing corner members 28 and 30 to provide a structurally rigid housing having a front elevational configuration essentially identical to that shown in FIG. 2 for the front panel or cover 20.

It will be noted from several figures of the accompanying drawings that each of the housing side members 22, 24 and 26 comprises a web 32 which is integrally formed along its rear edge with an inwardly directed flange 34 which is in turn integrally formed with a forwardly projecting flange 36 which is inwardly spaced apart from the web 32 to define therewith a first channel 38. It should perhaps be explained that, when reference is made herein to forward, rearward, inward and outward directions, such references are intended to signify directions relative to the housing 18. For example, the forward direction is that direction which extends from the rear of the housing 18 toward its front, the rearward direction being the opposite one. The inward direction is that direction which is normal to the forward and rearward directions and which extends from outside the housing 18 toward the inside of that housing.

Generally along the front edge of the web 32, there is integrally formed therewith an inwardly directed flange 40 which is in turn integrally formed with a rearwardly directed flange 42 defining with the web 32 a second channel 44 opposing the first channel 38.

Referring now to FIGS. 5, 7 and 8, it will be seen that the lower corner members 30 each comprises an outwardly convex web 46 from the opposite ends of which there extend linear web-like tongues or plates 48, each having a width which is very slightly less than the distance between the flanges 34 and 40 of the housing side members 22, 24 and 26 so allowing the edge portions of the tonges 48 to be received in the aforementioned channels 38 and 44 of adjacent ones of those housing side members during assembly of the housing 18. Screws 50 passing through holes 52 in the flanges 36 and 42 and received in threaded holes 54 in the tongues 48 serve as housing locking members to maintain the housing corner members connected to adjacent ones of the housing side members. It should be noted that some of the screws 50 have been omitted from the accompanying drawings.

Before continuing the description herein of the structure of the lower housing corner members 30, it will be explained with reference to FIG. 9 that the upper housing corner members 28 have essentially the same structure and differ from the lower housing corner members 30 principally in that they are formed with outwardly concave webs 56 instead of the outwardly convex webs 46. Those parts of the upper housing corner members 28 which are identical with the corresponding parts of the lower housing corner members 30 are identified by the same legends to avoid undue duplication of the description herein.

The sign structure 16 shown in the accompanying drawings if of the so-called single-sided type and, therefore, has only a front panel or cover but no corresponding rear panel or cover, the sign structure 16 being intended to be mounted on a vertical structural surface. For such purpose, holes 58 are provided in the aforementioned flanges 34 of the housing side members 22, 24 and 26 as well as through aligned inwardly projecting flanges 60 formed on the housing corner members 28 and 30.

Comparison of the corner members 28 and 30 shown in FIGS. 5 and 9 respectively will show that, for the particular structure illustrated, the flanges 60 of the lower housing corner members 30 are cut square to abut the corresponding square-cut ends of the adjacent housing side members while the flanges 60 of the upper housing corner members 28 are shown as being mitred for abutment with correspondingly mitred end edges of the adjacent housing side members. It will, of course, be understood that such edges of the flanges 60 can be square-cut or mitred as desired.

Having completed the description herein of the general construction of the housing 18 and of the manner in which the several side members and corner members thereof interfit and are interconnected, the description herein will now proceed with an explanation of the general construction of the front panel or cover 20 before an explanation is given of the co-operating structures provided on the housing 18 and on the front panel or cover 20 for releasably securing those two units together.

From FIG. 1, it will be seen that the front panel 20 has the same external front elevational configuration as the housing 18. The front panel 20 is formed in a generally similar manner to that of housing 18 and comprises a top frame member generally indicated at 62, a bottom frame member generally indicated at 64, two side frame members generally indicated at 66, two outwardly concave upper frame corner members generally indicated at 68 and two outwardly convex lower frame corner members generally indicated at 70, only one of each of the members 66, 68 and 70 being visible in FIG. 1.

The frame members 62, 64 and 66 are all formed as identical elongated linear extrusions cut to suitable lengths and, as will readily be seen from FIGS. 3 and 4, such extrusion comprises a box-like channel 72 defined by webs 74, 76 and 78 and 80 with spaced apart rearwardly directed lips 82 and 84 being provided on the rear surface of the web 74. For a reason yet to be explained, an outwardly projecting lip 86 is formed on the web 80 in close proximity to the web 78 to define therewith a narrow channel 88.

The frame members 62, 64 and 66 of the frame 20 are interconnected and separated by the corner members 68 and 70 which are similar in construction to each other and differ only in that the former have an outwardly concave configuration and are mitred to abut the mitred ends of the top frame member 62 and the mitred upper ends of the side frame members 66 and in that the lower frame corner members 70 are outwardly convex and are square-cut to abut the square-cut lower ends of the side frame members 66 and the square-cut ends of the bottom frame member 64. Identical component parts of the upper and lower frame corner members 68 and 70 respectively are identified by the same legends.

Referring now to FIGS. 6, 7 and 8, it will be noted that each lower frame corner member 70 comprises an outwardly convex solid body generally indicated at 90 and having a front surface 92, a rear surface 94, an outer surface 96 and a stepped inner surface 98 which is cut to provide a slot or recess 100. From each end of the solid body 90, there projects a linear tongue generally indicated at 101 and having a stepped sectional configuration defined by an outer surface 102, a rear surface 104, inwardly facing step surfaces 106 and 108 and forwardly facing surfaces 110, 112 and 114. The rear surface 104 and the surface 114 define a relatively thin inwardly projecting flange 116. The tongues 101 are dimensioned so that they can be inserted into the ends of the adjacent ones of the frame members with the outer surface 102 contiguous with the inner surface of the web 76 of the respective frame member, the rear surface 104 contiguous with the front surface of the web 78 of the respective frame member, the forwardly facing surface 110 contiguous with rear edge of the lip 82 of the respective frame member and with the flange 116 received in the aforementioned channel 88 of the respective frame member so ensuring a non-rotational interfit with such frame members.

The solid body of the upper frame corner member 68 is indicated in FIG. 10 by the legend 118 in view of its provision with mitred rather than square-cut end surfaces.

In order to secure the frame members 62, 64 and 66 to the frame corner members 68 and 70 after assembly in the manner already explained, screws 120 extend through holes 122 provided in the webs 78 of those frame members and screw into threaded holes (not shown) provided in the bodies of the tongues 101 as will best be understood with reference to FIG. 6.

Further reference will now be made to FIGS. 3 and 4 to explain the structure provided for releasably mounting the front panel 20 on the housing 18. For this purpose, all the housing side members 22, 24 and 26 are integrally formed with arcuate flanges 124 which project first inwardly from the flanges 42 and then forwardly, as well as with integrally formed members 126 which project directly forwardly from the inner ends of the flanges 40 and which terminate in inwardly and forwardly extending oblique lips 128. A continuous groove 130 is formed in the outer surface of each of the lips 128 for receiving a resiliently compressible seal 132 of rubber or other suitable material. Such seal is usefully adhesively bonded in position in such grooves. The member 126 and the arcuate flange 124 on each housing side member together define a forwardly open female channel 134 and constitute a first supporting means of a sign structure in accordance with this invention.

Removably received within the channels 134 of the housing side members 22, 24 and 26 are members 136 integrally formed with the webs 78 of the frame members 62, 64 and 66. Each member 136 has a generally J-shaped sectional configuration and such members 136 constitute the second supporting means of a sign structure in accordance with this invention. Screws 138 are threaded into bores formed in the members 126 of the housing side members to permit relative pivoting of a frame member relative to the adjacent housing side member to which it is coupled but to prevent complete detachment of that frame member from that housing side member. It will of course be understood that, in the assembled sign structure 16, such pivotal movement of the front panel 20 about one of its edges will be possibly only after the screws 138 along all the other sides of the front panel 20 have been removed or at least loosened sufficiently to allow the J-shaped members 136 to move out of the corresponding channels 134. Such screws 138 constitute the releasable securing means of a sign structure in accordance with this invention.

In order to provide an effective weather seal to prevent moisture such as rain from entering into the aforementioned channels 134, the frame members 62, 64 and 66 are each formed with a flange 140 which projects rearwardly from the web 78 outwardly of the member 136 and which terminates in an outwardly projecting flange 142 defining with the outer part of the web 78 an outwardly facing channel 143. A rib 144 (FIG. 3) is formed on the inner face of the flange 140 for sealing engagement with the aforesaid seal 132. The channel 143 serves to assist the flow of rainwater off the top surface of the sign structure.

In accordance with one very important feature of this invention, it has been found that, while it is not necessary to provide the housing corner members 28 and 30 and the frame corner members 68 and 70 with first and second supporting members corresponding to the aforementioned channels 134 and members 136 respectively, it is essential to provide those corner members with sealing means so as to ensure a positive seal between the housing 18 and the front panel 20 about its entire periphery. For this purpose, the housing corner members 28 and 30 are formed as particularly shown in FIGS. 7 and 8 each with a forwardly projecting flange 146 which is provided in its sloping front edge surface with a groove 148 for receiving the seal 132. Similarly, the frame corner members 68 and 70 are formed with rearwardly projecting flanges 150 and outwardly projecting flanges 152, defining channels 153, a rib 154 being formed on each flange 150 for sealing engagement with such seal 132.

The sign structure 16 is completed by a planar pane or panel 156 of suitable material, the edge portions of which extend between the lips 84 and the opposed edges of the webs 80 of the box-like channels 72 of the frame members 62, 64 and 66 as well as into the aligned recesses 100 provided for such purpose in the frame corner members 68 and 70. It is usefully noted that the edge surfaces of the pane 156 are disposed somewhat inwardly of the outer webs 76 of the channels 72 of the frame members 62, 64 and 66 and of the surfaces 106 of the frame corner members 68 and 70 to allow for thermal expansion and contraction of such pane 156.

The pane 156 can be formed of any suitable material such as a plastics material or glass and will normally be in the form of translucent sheet having characters or other graphic design or information delineated thereon by contrasting colours or by opaque areas.

Having completed the description herein of the construction of the sign structure 16, the manner in which that structure is assembled from its component parts will now be briefly reviewed. To effect such assembly, the housing side members 22, 24 and 26 and the frame members 62, 64 and 66 are first cut from the appropriate extrusions to the desired lengths, being square-cut or mitred according to the end edge configurations of the corner members to which they are to be attached.

The web-like tongues 48 of the housing corner members 28 and 30 are then inserted into the ends of the housing side members 22, 24 and 26 as already explained and secured in position by means of the screws 50. The continus seal is then bonded in position in the grooves 130 and 148.

The frame members 62, 64, and 66 and the frame corner members 68 and 70 are then assembled by inserting the tongues 101 into the ends of the frame members 62, 64 and 66 as already described after having positioned the edges of the pane 156 in the pane-receiving recesses already identified. The screws 120 are then tightened to maintain the frame 20 in its assembled configuration.

The J-section members 136 projecting rearwardly from the frame members 62, 64 and 66 are then inserted into the forwardly facing channels 134 on the housing side members 22, 24 and 26 and the screws 138 are tightened positively but releasably to hold the frame 20 in position on and closing the front face of the housing 18.

Finally, reference will be made to FIGS. **11*a* to 11*d*** which show merely by way of example four different front elevational configurations for sign structures in accordance with this invention.

The sign structure generally indicated at 160 in FIG. **11*a* is formed with four outwardly convex corners and is, therefore, shown as having four frame corner members 70**.

The sign structure generally indicated at 162 in FIG. **11*b* is shown as being provided with four outwardly concave corners and is shown as having two outwardly concave frame corner members 68 and two outwardly concave frame corner members 164** provided with square-cut end edges rather than mitred ones.

The sign structure indicated generally at 166 in FIG. **11*c* has a generally cruciform configuration and is shown in that figure as being formed from eight outwardly convex frame corner members 70, four outwardly concave frame corner members 68 and twelve linear frame members all of which are for convenience indicated by the legend 66**.

The sign structure indicated generally at 168 in FIG. **11*d* is similar in that it is formed in part from five linear frame members 66, four convex frame corner members 70 and two concave frame corner members 68. It differs from the other sign structures hereinbefore specifically described, however, in that it also comprises linear frame members 170 and 172** which are interconnected in a conventional manner using hidden corner splices or gussets (not shown) for the purpose of demonstrating the great versatility in sign design made possible by this invention particularly when used in conjunction with known prior art procedures.

Other variations in and modifications of the sign structure hereinbefore specifically described are also possible. For example, while the sign structures in accordance with this invention and as illustrated in the accompanying drawings are all of the so-called single-sided type, this invention equally embraces double-sided sign structures which are usefully obtained by applying the teaching of this invention to the additional provision of a rear panel of identical structure to the front panel 20.

The foregoing is a description of several preferred embodiments of the invention and is given here by way of example only. The invention is not to be taken as limited to any of the specific features as herein described but comprehends all such variations thereof as come within the scope of the appended claims.

What is claimed is:

1. A sign structure having a housing, of predetermined length and breadth, and a moveable front panel of corresponding length and breadth, and which comprises:

at least four elongated linear housing side members providing structurally rigid housing side walls;

at least four housing corner members respectively interconnecting adjacent ones of said housing side members in spaced apart relation;

first supporting formations formed integrally on said linear side members and extending forwardly thereof, and said housing corner members being free of said supporting formations thereby defining discontinuous supporting formations around said housing;

housing locking members securing each of said housing corner members adjacent ones of said housing side members;

at least four elongated linear frame members co-extensive with corresponding ones of said housing side members and providing a structurally rigid frame for said front panel at least four frame corner members respectively interconnecting two adjacent ones of said frame members and co-extensive with said housing corner members;

second supporting formations formed integrally with said linear frame members and extending rearwardly thereof, and said frame corner members being free of said supporting formations thereby defining discontinuous second supporting formations around said front panel;

frame locking members securing each of said frame corner members to adjacent ones of said frame members;

recesses in said frame members and similar recesses in said frame corner members in end abutting relation, such recesses being disposed in a common plane to define a continuous endless recess for receiving edge portions of a front panel;

seal flange means formed on said housing side members, and similar seal flange means formed on said housing corner members in end abutting relation to form a continuous endless seal flange means;

cooperating sealing means formed on said frame side members, and similar sealing means formed on said frame corner members in end abutting relation to form a continuous endless sealing means in registration with said seal flange means;

a resiliently compressible continuous endless seal disposed between said seal flange means and said sealing means for sealing between said housing and said front panel, and, releasable securing means releasably maintaining said first supporting means and said second supporting means in engagement with each other thereby securing said front panel on said housing with said seal being compressed to restrict the passage of moisture into said housing.

2. A sign structure as claimed in claim 1 and in which said housing corner members and said frame corner members have corresponding arcuate elevational configurations.

3. A sign structure as claimed in claim 2 and in which said housing corner members and said frame corner members have outwardly convex configurations.

4. A sign structure as claimed in claim 2 and in which said housing corner members and said frame corner members have outwardly concave configurations.

5. A sign structure as claimed in claim 1 and in which said housing corner members and said frame corner members are each formed with two arms outwardly projectine therefrom in different directions and received within openings therefor in respective ones of said housing side members and said frame members respectively, said housing locking members and said frame locking members being adapted to retain said arms within respective ones of said openings.

6. A sign structure as claimed in claim 5 and in which said housing side members and said frame members are in the form of elongated extrusions having flanges defining said recesses for receiving edge portions of a front panel and flanges defining channels constituting said openings for receiving respective ones of said arms.

7. A sign structure as claimed in claim 6 and in which said two adjacent ones of said housing side members and said two adjacent ones of said frame members are formed, adjacent said housing corner member and said frame corner member respectively, with end edge surfaces which are perpendicular to the longitudinal directions of those housing side members and frame members respectively.

8. A sign structure as claimed in claim 1, in which said first supporting means are provided on first and second ones of said housing side members, in which said second supporting means are provided on corresponding first and second ones of said frame members, and in which said first and second supporting means and said releasable securing means are adapted to permit pivotal movement of said front panel frame relative to said housing on release of said first and second supporting means along said first housing side member, such pivotal movement then being about an axis extending generally along a front edge of said second housing side member.

9. A sign structure as claimed in Claim 1 and in which said seal flange defines a continuous groove formed in all said housing side members and in said housing corner members for reception of said seal therein, and in which said sealing means defines a continuous rib formed on all said frame members and on said frame corner members, for sealing engagement with said seal.

* * * * *